US011260548B2

(12) United States Patent
Shimizu et al.

(10) Patent No.: US 11,260,548 B2
(45) Date of Patent: Mar. 1, 2022

(54) HAIR CUTTING DEVICE

(71) Applicant: Panasonic Intellectual Property Management Co., Ltd., Osaka (JP)

(72) Inventors: Hiroaki Shimizu, Shiga (JP); Ryo Suzuki, Shiga (JP); Kotaro Yanagi, Shiga (JP); Shoki Okura, Shiga (JP); Hiroki Inoue, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/976,048

(22) Filed: May 10, 2018

(65) Prior Publication Data

US 2018/0333874 A1 Nov. 22, 2018

(30) Foreign Application Priority Data

May 17, 2017 (JP) ..... JP2017-098238

(51) Int. Cl.
*B26B 19/04* (2006.01)
*B26B 19/38* (2006.01)
*B26B 19/14* (2006.01)

(52) U.S. Cl.
CPC ..... *B26B 19/048* (2013.01); *B26B 19/146* (2013.01); *B26B 19/386* (2013.01)

(58) Field of Classification Search
CPC .... B26B 19/048; B26B 19/146; B26B 19/386
USPC ..... 30/42, 43.7–43.92
See application file for complete search history.

(56) References Cited

U.S. PATENT DOCUMENTS 5,159,755 A * 11/1992 Jestadt ..... B26B 19/046 30/43.91
5,704,126 A * 1/1998 Franke ..... B26B 19/046 30/43.91
6,357,118 B1 * 3/2002 Eichhorn ..... B26B 19/048 30/43.92

(Continued)

FOREIGN PATENT DOCUMENTS

CN 1585688 A 2/2005
CN 101797757 A 8/2010

(Continued)

OTHER PUBLICATIONS

Chinese Search Report dated Oct. 10, 2020 for the related Chinese Patent Application No. 201810448923.1 with English translation.

*Primary Examiner* — Jason Daniel Prone
(74) *Attorney, Agent, or Firm* — McDermott Will & Emery LLP

(57) ABSTRACT

A hair cutting device includes a grip, a head disposed external to one end of the grip, the head including a cutting unit that works on hair, and a joint connecting the grip and the head. The joint includes a base connected to one of the grip and the head, and a slide portion connected to the other of the grip and head and held to be slidable within a predetermined area on a slide plane that is a plane intersecting an alignment of the grip and the head. Accordingly, the hair cutting device including the head that has an excellent ability to lessen impact which is made when the head hits the skin and to follow the skin surface is provided.

11 Claims, 13 Drawing Sheets

(56) References Cited

U.S. PATENT DOCUMENTS 6,892,457 B2 * 5/2005 Shiba ..... B26B 19/048 30/43.92
7,020,966 B2 * 4/2006 Shiba ..... B26B 19/046 30/346.51
7,162,801 B2 * 1/2007 Royle ..... B26B 19/048 30/43.92
7,334,338 B2 * 2/2008 Shiba ..... B26B 19/04 30/346.51
7,461,456 B2 * 12/2008 Tsushio ..... B26B 19/048 30/43.92
8,627,574 B2 * 1/2014 Shimizu ..... B26B 19/048 30/42
8,631,582 B2 * 1/2014 Takaoka ..... B26B 19/288 30/43.92
8,720,069 B2 * 5/2014 Iwashita ..... B26B 19/048 30/346.51
8,819,946 B2 * 9/2014 Yamasaki ..... B26B 19/048 30/43
8,844,141 B2 * 9/2014 Van Der Borst et al. ..... B26B 19/14 30/43.4
9,545,729 B2 * 1/2017 Buck, Jr ..... B26B 19/205
9,729,023 B2 * 8/2017 Komori ..... B26B 19/3866
9,987,759 B2 * 6/2018 Molema ..... B26B 19/048
10,071,490 B2 * 9/2018 Shimizu ..... B26B 19/282
10,434,669 B2 * 10/2019 Suzuki ..... B26B 19/28
2304/0231160 11/2004 Shiba et al.
2008/0034591 A1 * 2/2008 Fung ..... B26B 19/02 30/43.92
2009/0241343 A1 * 10/2009 Yamasaki ..... B26B 19/048 30/43.92
2010/0180448 A1 * 7/2010 Sato ..... B26B 19/046 30/43.92
2011/0094107 A1 * 4/2011 Ring ..... B26B 19/048 30/43.1
2012/0216409 A1 * 8/2012 Shigeta ..... B26B 19/288 30/43.91
2016/0151922 A1 6/2016 Shimizu et al.
2018/0085939 A1 * 3/2018 Krauss ..... B26B 19/042
2018/0085949 A1 * 3/2018 Krauss ..... B26B 19/048
2018/0311841 A1 * 11/2018 Kraus ..... B26B 19/048
2018/0319028 A1 * 11/2018 Kraus ..... H02K 33/16

FOREIGN PATENT DOCUMENTS

JP 2006-255335 A 9/2006
JP 2016-101366 A 6/2016

* cited by examiner

HAIR CUTTING DEVICE

RELATED APPLICATIONS

This application claims the benefit of Japanese Application No. 2017-098238, filed on May 17, 2017, the disclosure of which is incorporated in its entirety by reference herein.

BACKGROUND

1. Technical Field

The present disclosure relates to a hair cutting device.

2. Description of the Related Art

A hair cutting device, such as a conventional electric razor, includes a grip to be grasped by a user, a head including a cutting unit that cuts hair and the like, and a support portion that allows the head to pivot relative to the grip.

To be more specific, a hair cutting device (electric razor) including a support portion that allows a head to pivot on two different axes relative to a grip and further allows the head to extend and retract relative to the grip is disclosed in, for example, Unexamined Japanese Patent Publication No. 2016-101366 (hereinafter, referred to as "PTL 1").

In the hair cutting device described in PTL 1, the head pivots in a front-back direction or a horizontal direction. This configuration allows the head to easily follow the skin. Furthermore, when being pressed against the skin, the head retracts toward the body. This configuration lessens impact on skin made by the head.

However, such a conventional hair cutting device may fail to suitably lessen the impact on the skin made by the head, due to some relative positional relationships between the head and the skin.

SUMMARY

The present disclosure provides a hair cutting device capable of suitably lessening impact on skin, which is made when a head is pressed against the skin.

A hair cutting device according to an aspect of the present disclosure includes a grip, a head disposed external to one end of the grip, the head including a cutting unit that works on hair, and a joint connecting the grip and the head. The joint includes a base and a slide portion. The base is connected to one of the grip and the head. The slide portion is connected to another of the grip and the head that is different from the one the base is connected to. Further, the slide portion is held to be slidable within predetermined area on a slide plane that is a plane intersecting an alignment of the grip and the head.

Such a hair cutting device is capable of suitably lessening impact on skin which is made when the head is pressed against the skin.

DETAILED DESCRIPTION

Figure 1:
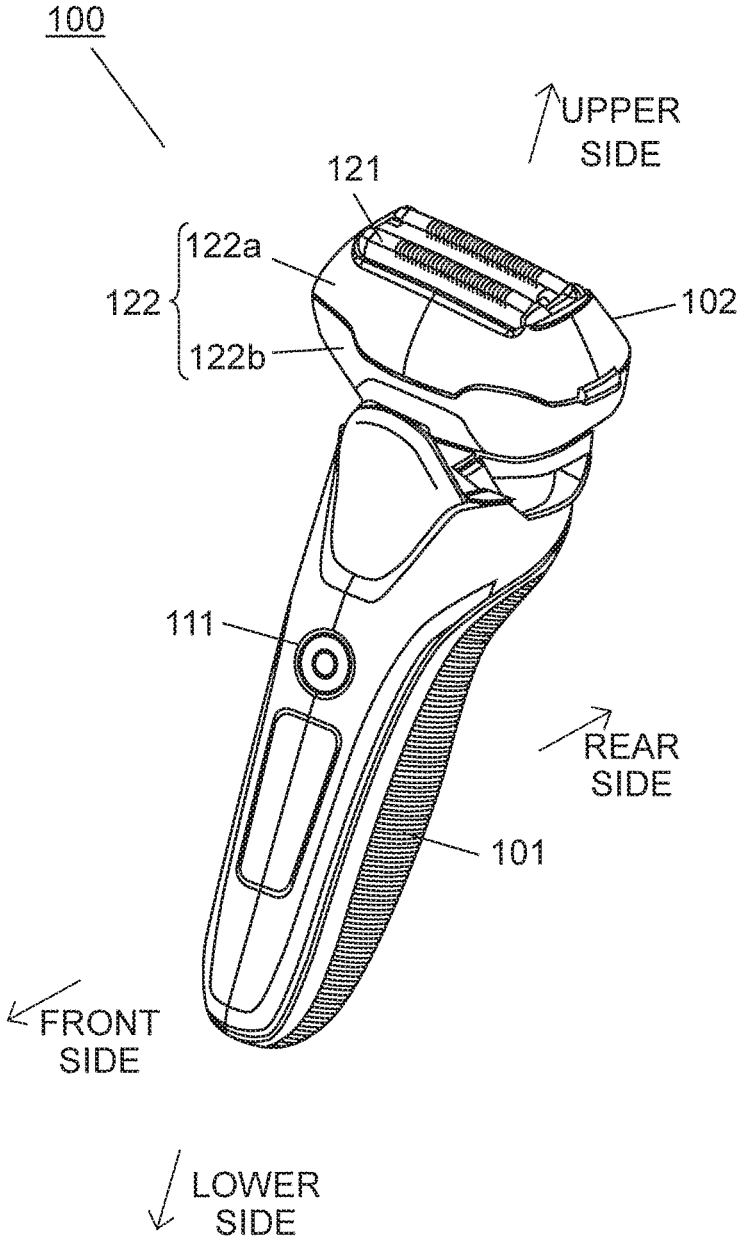
FIG. 1 is a perspective view illustrating an external appearance of a hair cutting device according to the present exemplary embodiment.

An exemplary embodiment of a hair cutting device according to the present disclosure will be described with reference to the drawings. Note that the following exemplary embodiment exemplifies the hair cutting device according to the present disclosure. Therefore, the scope of the present disclosure is defined by the recitation in the claims with reference to the following exemplary embodiment. Thus, the present disclosure is not only limited to the following exemplary embodiment. That is, among constituent elements in the following exemplary embodiment, constituent elements not recited in any one of the independent claim that represents the most generic concept of the present disclosure are not necessarily essential for achievement of the object of the present disclosure. However, such constituent elements will be described as constituent elements of preferred embodiments.

Furthermore, the drawings are schematic drawings in which emphasis, omission, and proportion adjustment are made as required for illustration of the present disclosure. Thus, shapes, positional relationships, and proportions in the drawings may differ from their respective actual shapes, positional relationships, and proportions.

Exemplary Embodiment

A hair cutting device according to an exemplary embodiment of the present disclosure will be hereinafter described with reference to FIGS. 1 and 2.

FIG. 1 is a perspective view illustrating an external appearance of hair cutting device 100 according to the present exemplary embodiment. FIG. 2 is an exploded perspective view of joint 103 of hair cutting device 100.

Figure 2:
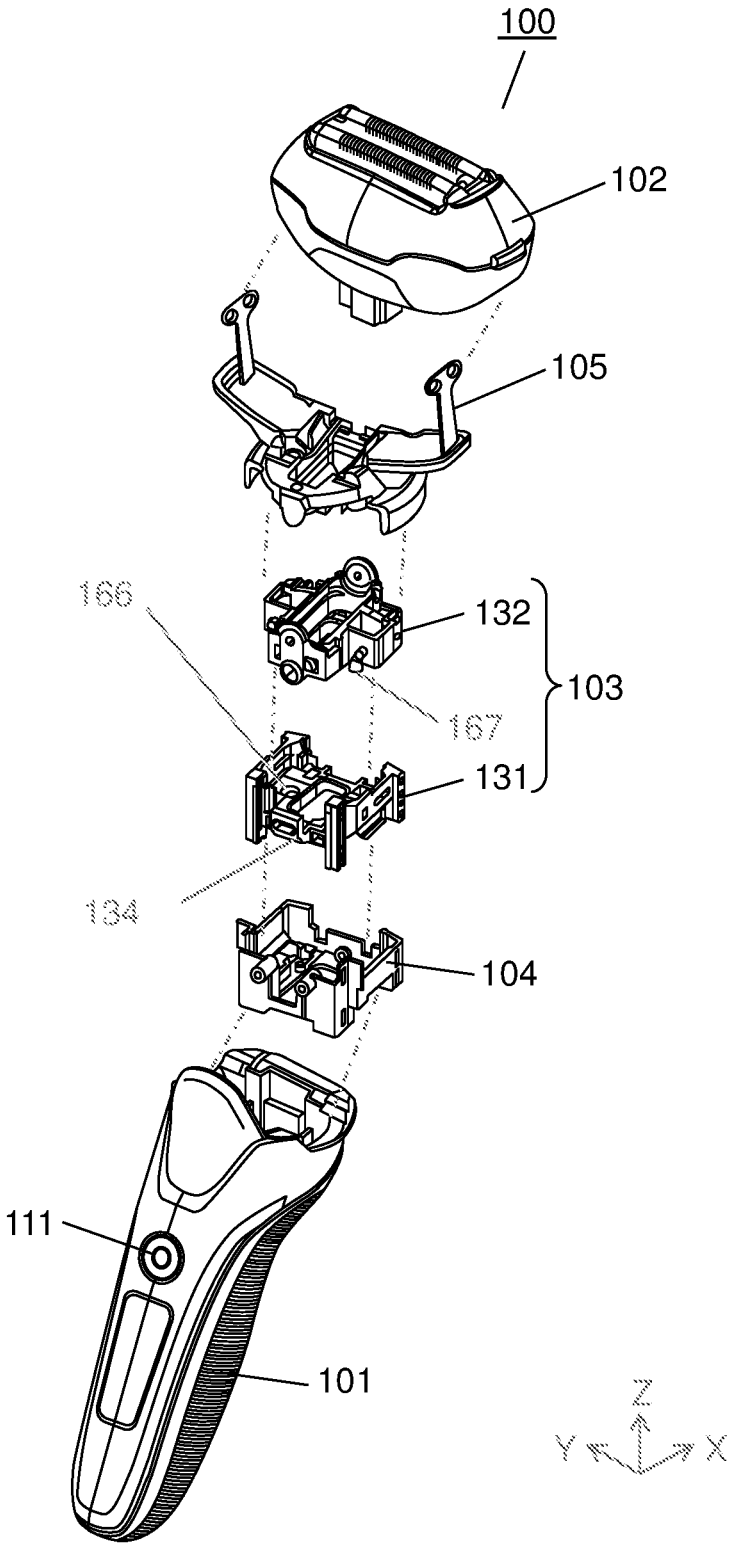
FIG. 2 is an exploded perspective view of a joint of the hair cutting device.

As illustrated in FIGS. 1 and 2, hair cutting device 100 according to the present exemplary embodiment is an appliance configured to, for example, cut or remove hair or the like. Hereinafter, an electric razor will be described as an example of hair cutting device 100.

To be more specific, hair cutting device 100 includes grip 101, head 102, joint 103, and the like.

Note that, in the following description, a side facing the front of grip 101 (a side facing power source switch 111 described below) may be referred to as a front side, a side facing the rear of grip 101 may be referred to as a rear side, a side facing head 102 in an alignment of grip 101 and head 102 may be referred to as an upper side, a side facing grip 101 in the alignment of grip 101 and head 102 is referred to as a lower side, and a direction orthogonal to a front-back direction and a vertical direction may be referred to as a horizontal direction.

Grip 101 is a portion that is gripped by a user when the user uses hair cutting device 100. Grip 101 is formed of a tubular housing having contours adapted to hands. The housing accommodates a power supply unit that supplies power, a circuit board that executes various control, and the like. Grip 101 includes, for example, power source switch 111 on the front of grip 101, and operation member 109 (see FIG. 14) on the rear of grip 101. Power source switch 111 is operated to switch between power on and off. Operation member 109 releasably prevents, for example, pivot actions of head 102 relative to grip 101.

Head 102 is disposed external to one end of grip 101. Head 102 is a portion that comes into contact with skin and directly cuts hair and the like on the skin. Head 102 includes at least one cutting unit 121. Cutting unit 121 includes, for example, a blade block having outer blades and inner blades that cut hair.

Head 102 further includes head case 122, a driving source and a transmission mechanism (not illustrated), and the like. Head case 122 holds cutting unit 121 such that the outer blades of the blade block are exposed on an upper end of head 102. The driving source is accommodated in head case 122 and drives the inner blades of cutting unit 121 in, for example, the horizontal direction. The transmission mechanism transmits driving force from the driving source to the inner blades of cutting unit 121.

Head case 122 includes upper case 122*a* and lower case 122*b*. That is, upper case 122*a* is attached to lower case 122*b*, which forms head case 122. In upper case 122*a*, at least one cutting unit 121 is disposed. Lower case 122*b* is connected with grip 101 via joint 103.

This configuration allows head 102, as described below, to pivot relative to grip 101 in the front-back direction and the horizontal direction and to move in the vertical direction relative to grip 101.

Note that, for hair cutting device 100 according to the present exemplary embodiment, cutting unit 121 of an oscillating type in which the inner blades reciprocate along a single axis (horizontal direction) relative to the outer blades has been described as an example; however, the present disclosure is not limited to the configuration. As the cutting unit, any cutting unit including, for example, a cutting unit of a rotating type may be employed.

Hair cutting device 100 according to the present exemplary embodiment is configured as described above.

A configuration of joint 103 of hair cutting device 100 will be described below with reference to FIGS. 3 to 6.

Figure 3:
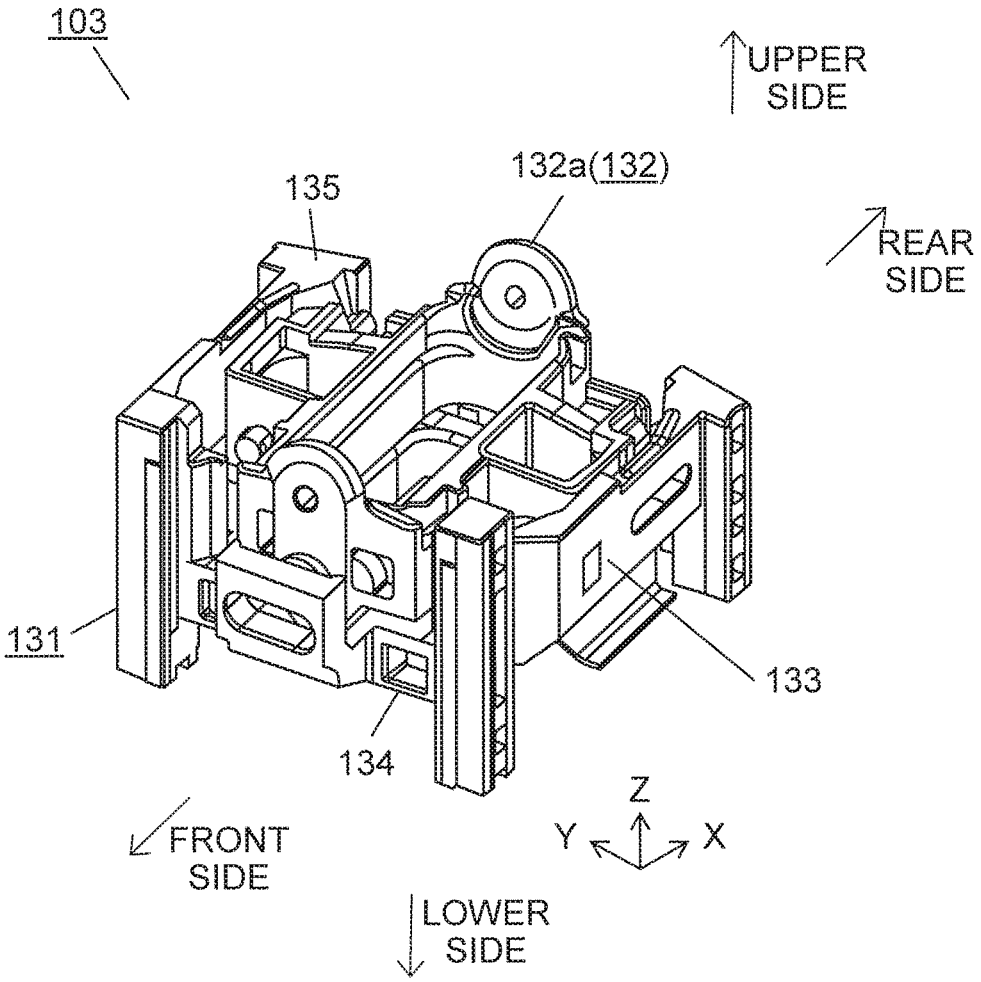
FIG. 3 is a perspective view of the joint.
Figure 4:
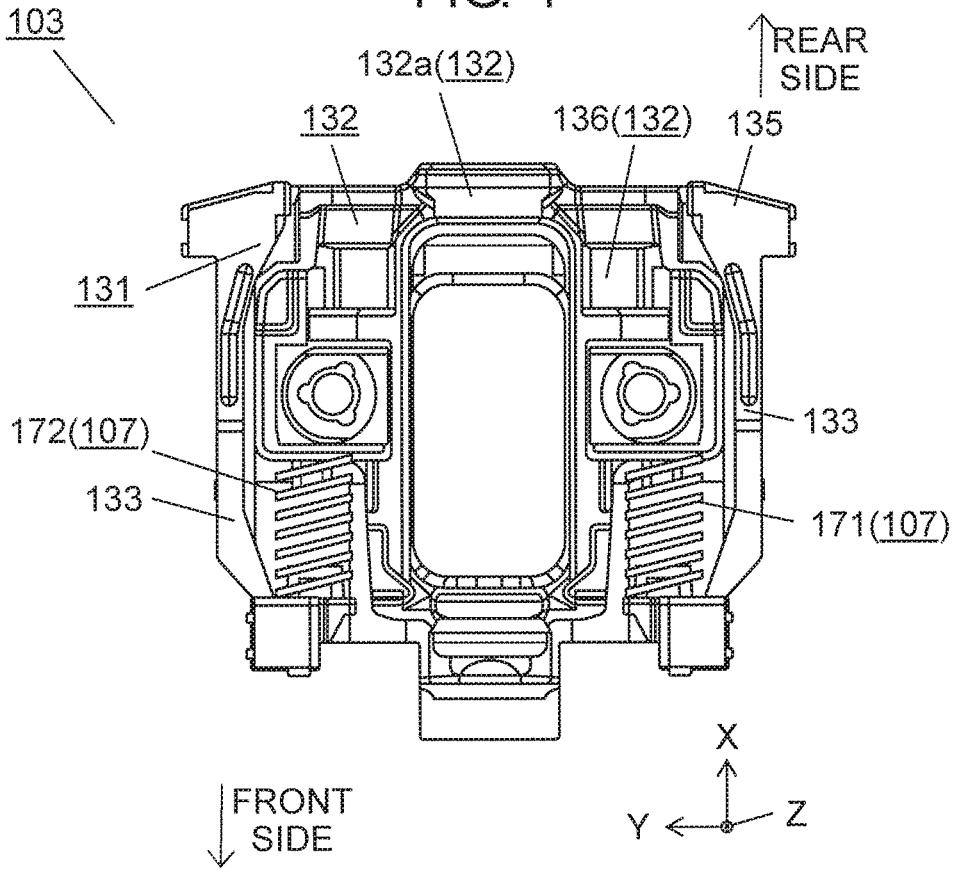
FIG. 4 is a top view of the joint.
Figure 5:
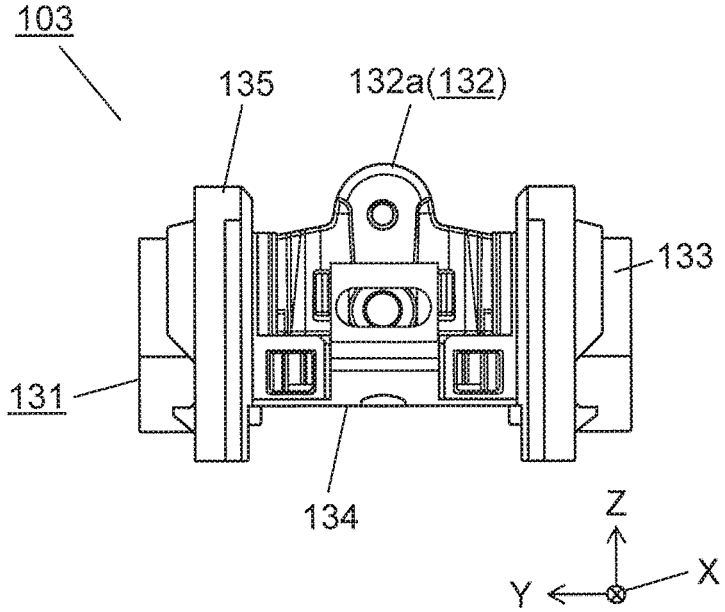
FIG. 5 is a front view of the joint.
Figure 6:
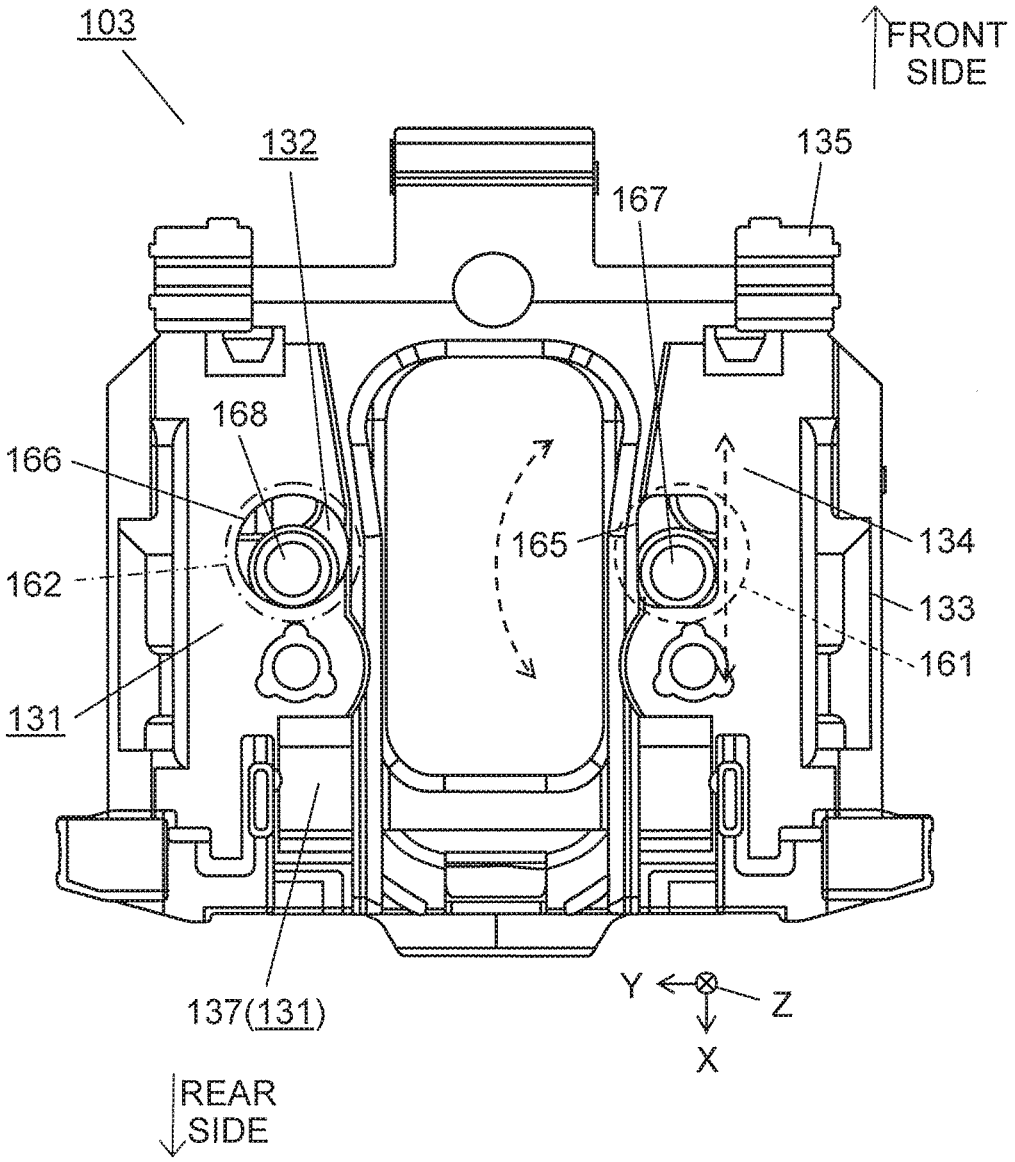
FIG. 6 is a bottom view of the joint.

FIG. 3 is a perspective view of joint 103. FIG. 4 is a top view of joint 103. FIG. 5 is a front view of joint 103. FIG. 6 is a bottom view of joint 103.

Joint 103 is a mechanism member that connects head 102 to grip 101 so as to allow head 102 to move in a predetermined direction.

To be more specific, joint 103 includes base 131, slide portion 132, and the like.

Base 131 is a member that is connected directly or indirectly to one of grip 101 and head 102. Note that, in the present exemplary embodiment, a configuration in which base 131 is connected to grip 101 via first holder 104 (described below) will be described as an example.

Base 131 is formed of a substantially rectangular box shaped (or a rectangular box shaped) member. Base 131 includes bottom surface 134, side walls 133, pillars 135, and the like. Bottom surface 134 is formed in a substantially rectangular shape (or a rectangular shape) and defines a slide plane corresponding to a plane parallel to an XY plane in the drawings. Side walls 133 vertically extend from a periphery of bottom surface 134. Pillars 135 are provided at four corners between side walls 133.

Base 131 accommodates slide portion 132 (described below) on the slide plane intersecting the alignment of grip 101 and head 102 (vertical direction) such that slide portion 132 is slidable along the XY plane. Base 131 further accommodates slide portion 132 such that slide portion 132 is fixed in a direction orthogonal to the slide plane (that is, Z-axis direction in the drawings or the vertical direction).

Slide portion 132 is a member that is connected directly or indirectly to another of grip 101 and head 102 so as to face base 131. In the present exemplary embodiment, a configuration in which slide portion 132 is connected to head 102 will be described as an example.

Slide portion 132 is held in base 131 so as to be slidable within a predetermined area on the slide plane. Slide portion 132 is accommodated in base 131 such that a surface on an inner side (upper side) of bottom surface 134 of base 131 and a bottom surface on an outer side (lower side) of slide portion 132 are in surface contact with each other. Slide portion 132 further includes, for example, bearing portion 132*a* to which second holder 105 (described below) is pivotably attached.

That is, grip 101 and head 102 are connected with each other via joint 103. This configuration allows head 102 to undergo slide displacement on the slide plane relative to grip 101. Accordingly, a range in which head 102 can move is wider. As a result, impact on skin made by head 102 is suitably lessened, regardless of relative positional relationships between head 102 and the skin against which head 102 is pressed.

Furthermore, head 102 can flexibly move relative to grip 101. Accordingly, an ability of head 102 to follow the skin surface is enhanced. This brings about better contact between the skin and a blade surface on which the outer blades of cutting unit 121 are arranged. As a result, shaving performance of the electric razor corresponding to hair cutting device 100 is enhanced.

As illustrated in FIG. 6, joint 103 further includes first restricting portion 161 and second restricting portion 162. First restricting portion 161 and second restricting portion 162 further restrict a range in which head 102 can undergo displacement on the slide plane relative to grip 101.

First restricting portion 161 is a structural portion that restricts slide movement in a rotation direction and slide movement in the front-back direction that is single axis (X-axis direction in the drawings), of slide portion 132 relative to base 131. First restricting portion 161 according to the present exemplary embodiment includes groove 165 and first protrusion 167 to be inserted into groove 165. Groove 165 is formed in an oblong shape extending in the front-back direction. First protrusion 167 is engaged with groove 165 of the oblong shape so as to be slidable along groove 165 in the front-back direction as indicated by a straight broken line with a bidirectional arrow in FIG. 6. First protrusion 167 is further engaged with groove 165 so as to be rotatable about groove 165 as indicated by a curved broken line with a bidirectional arrow in FIG. 6. Herein, first protrusion 167 is formed of a cylindrical member having a diameter approximately equal to a width of groove 165. This configuration does no limit movement of first protrusion 167 to movement in only one of the front-back direction and the rotation direction, but allows movement in both the front-back direction and the rotation direction at the same time.

Note that groove 165 according to the present exemplary embodiment is a through-slit formed through bottom surface 134 of base 131. Accordingly, first protrusion 167 is integrally formed with slide portion 132 so as to protrude from the bottom surface on the lower side of slide portion 132.

That is, first restricting portion 161 restricts movement of slide portion 132 on the slide plane relative to base 131 to slide movement in either one of the front-back direction and the rotation direction or slide movement in both the front-back direction and the rotation direction. This configuration prevents slide portion 132 from moving more than necessary. Furthermore, the movement of slide portion 132 lessens impact which is made when, for example, cutting unit 121 of head 102 hits the skin.

Moreover, the movement of slide portion 132 allows head 102 to more easily follow the skin surface. This brings about better contact between the blade surface of the outer blades of cutting unit 121 and the skin. For example, when hair cutting device 100 is moved from an area under a jaw toward a cheek, head 102 moves, like a twisting action relative to grip 101. This movement allows head 102 to suitably follow the skin surface even in an area where the skin surface has a complicated contour, which results in suitable contact with the blade surface.

Second restricting portion 162 is a structural portion that further restricts the movement of slide portion 132 relative to base 131 that is restricted by first restricting portion 161 to movement within a predetermined range. Second restricting portion 162 according to the present exemplary embodiment includes second protrusion 168 and hole 166. Second protrusion 168 is provided on one of base 131 and slide portion 132 so as to protrude in the same direction as the direction in which first protrusion 167 protrudes. Hole 166 is a through-hole provided through another of base 131 and slide portion 132. As slide portion 132 slides in the front-back direction, slides in the rotation direction about first protrusion 167, or slides in both the front-back direction and the rotation direction, second protrusion 168 moves within hole 166. Accordingly, second restricting portion 162 restricts the movement of slide portion 132 relative to base 131 to movement within an allowable predetermined range.

Herein, the "the same direction" refers to that on parallel axes or substantially parallel axes, first protrusion 167 and second protrusion 168 are arranged. In this case, respective directions in which first protrusion 167 and second protrusion 168 protrude are identical or opposite to each other.

In this configuration, hole 166 is formed in a shape different from a shape of groove 165 of first restricting portion 161. To be more specific, hole 166 has a size and a shape so as to allow second protrusion 168 to undergo displacement in all directions on the slide plane within the predetermined range. For example, hole 166 is formed in a circular shape having a diameter greater than the diameter of second protrusion 168.

That is, according to the above-described configuration, first restricting portion 161 and second restricting portion 162 are different from each other in their restriction ranges.

Furthermore, second restricting portion 162 is disposed side by side with first restricting portion 161 in a direction orthogonal to an extending direction of groove 165 of the rectangular shape of first restricting portion 161, as illustrated in FIG. 6. Accordingly, presence of first restricting portion 161 causes second restricting portion 162 to restrict slide movement, more than necessary, of slide portion 132 in the rotation direction. On the other hand, absence of first restricting portion 161 causes second restricting portion 162 to restrict the movement of slide portion 132 to slide movement in all directions on the slide plane and within the predetermined range. Moreover, second restricting portion 162 restricts the movement of slide portion 132 to slide movement in the rotation direction about second protrusion 168 and combined slide movement.

As described above, hair cutting device 100 according to the present exemplary embodiment includes at least one of first restricting portion 161 and second restricting portion 162. This configuration makes it possible to restrict a range in which head 102 moves to a desired range with a simple and small structure. As a result, head 102 can be prevented from moving more than necessary.

Note that, as described above, one of groove 165 and first protrusion 167 of first restricting portion 161 may be provided to one of base 131 and slide portion 132, so that groove 165 and first protrusion 167 face each other. Similarly, one of hole 166 and second protrusion 168 of second restricting portion 162 may be provided to one of base 131 and slide portion 132, so that hole 166 and second protrusion 168 face each other. For example, in a case where groove 165 and hole 166 are provided to base 131, first protrusion 167 and second protrusion 168 are provided to slide portion 132 so as to face groove 165 and hole 166, respectively.

Furthermore, groove 165 and hole 166 need not be the above-described through-slit and through-hole, respectively. Groove 165 and hole 166 may be, for example, bottomed recesses. That is, provided that base 131 and slide portion 132 are engaged with each other in a concave-convex relationship, any shape may be employed.

Joint 103 according to the present exemplary embodiment further includes first biasing member 171 and second biasing member 172 as illustrated in FIG. 4. Note that, hereinafter, first biasing member 171 and second biasing member 172 may be collectively referred to as biasing member 107.

Biasing member 107 is an elastic member that biases slide portion 132 toward base 131 on the slide plane in a slide direction (for example, in the front-back direction). That is, biasing member 107 presses slide portion 132 to base 131. This configuration causes biasing member 107 to hold slide portion 132 at an initial position relative to base 131 with no force applied to head 102.

Note that biasing member 107 is, for example, a coil spring. Biasing member 107 is accommodated in base 131 between an inner surface of side wall 133 of base 131 and an outer surface of slide portion 132.

First biasing member 171 is disposed on an extension of groove 165 of first restricting portion 161 (in the front-back direction). That is, first biasing member 171 is disposed so as to apply biasing force in the extending direction of groove 165. Second biasing member 172 is disposed adjacent to second restricting portion 162 in parallel to the slide plane and side by side with first biasing member 171.

That is, second biasing member 172 is disposed at a position where a bias direction extends through second protrusion 168 of second restricting portion 162. Second biasing member 172 is disposed so as to apply biasing force in a direction identical to the direction in which first biasing member 171 applies the biasing force.

In other word, first biasing member 171 and second biasing member 172 according to the present exemplary embodiment are arranged at the same positions in the front-back direction of joint 103 and side by side with each other at a predetermined interval. Then, biasing member 107 biases slide portion 132 in the front-back direction. While, in this configuration, biasing member 107 is preferably disposed so as to bias slide portion 132 in a direction from the front side toward the rear side, biasing member 107 may also be disposed so as to bias slide portion 132 in the opposite direction. This configuration causes biasing member 107 to return head 102 to the initial position as described above. Additionally, this configuration causes biasing member 107 to make the lessening of impact on skin made when head 102 hits the skin more suitable.

Joint 103 of hair cutting device 100 is configured as described above.

Next, description will be given of the movement of joint 103 of hair cutting device 100 with reference to FIGS. 7 to 11.

Note that the movement to be described below is a typical example. That is, slide portion 132 of joint 103 can freely move within the predetermined range restricted relative to base 131, in response to actual force applied to head 102.

FIGS. 7 to 11 are bottom views illustrating different examples of the movement of joint 103. Note that FIGS. 7 to 11 illustrate examples where biasing member 107 biases slide portion 132 from the front side toward the rear side.

Figure 7:
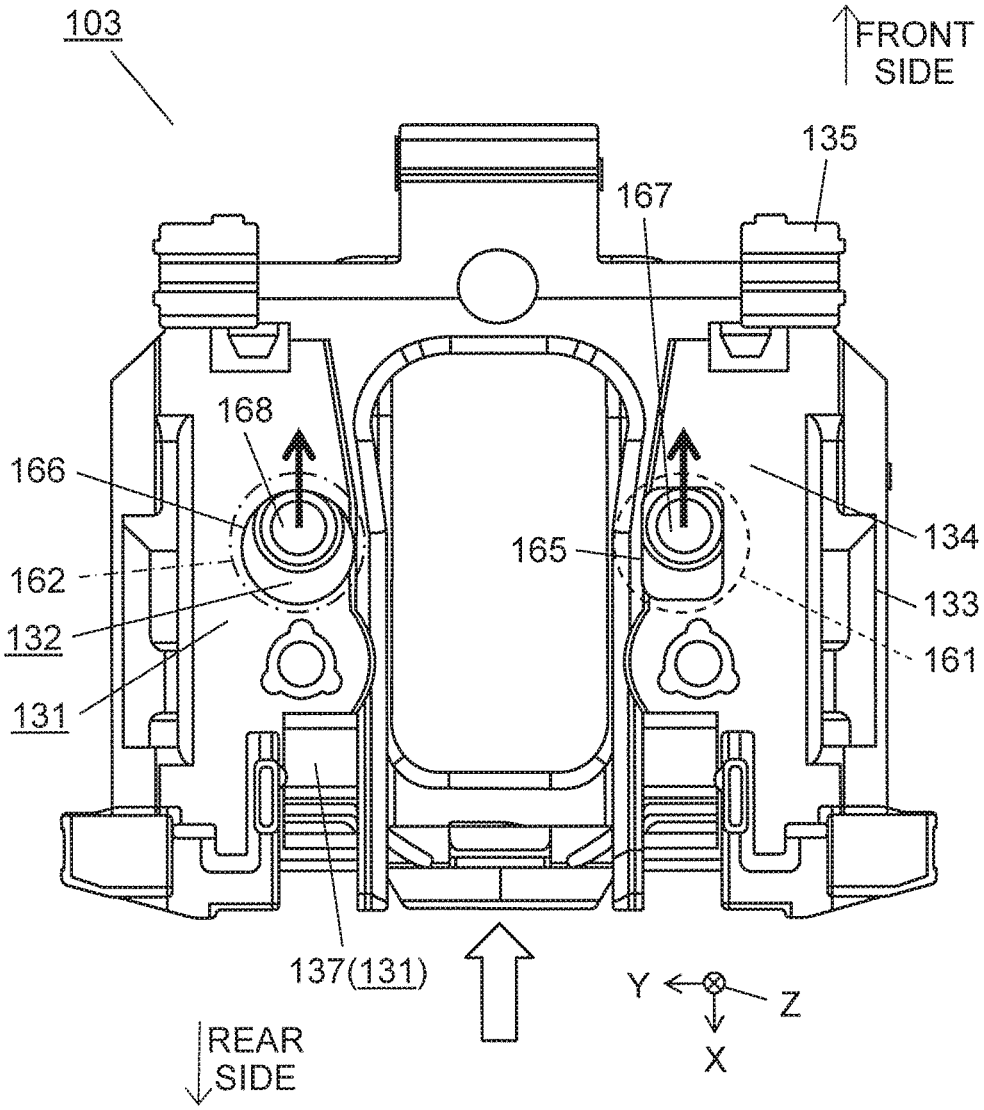
FIG. 7 is the bottom view of the joint, illustrating an example of movement of the joint.

To be more specific, FIG. 7 illustrates movement of joint 103 relative to grip 101 in a case where force from the rear side to the front side indicated by a white arrow is applied to a portion near the center of head 102 in the horizontal direction. In this case, as indicated by the arrow in FIG. 7, slide portion 132 of joint 103 moves, in the front-back direction, in substantially parallel (or in parallel) to base 131.

Figure 8:
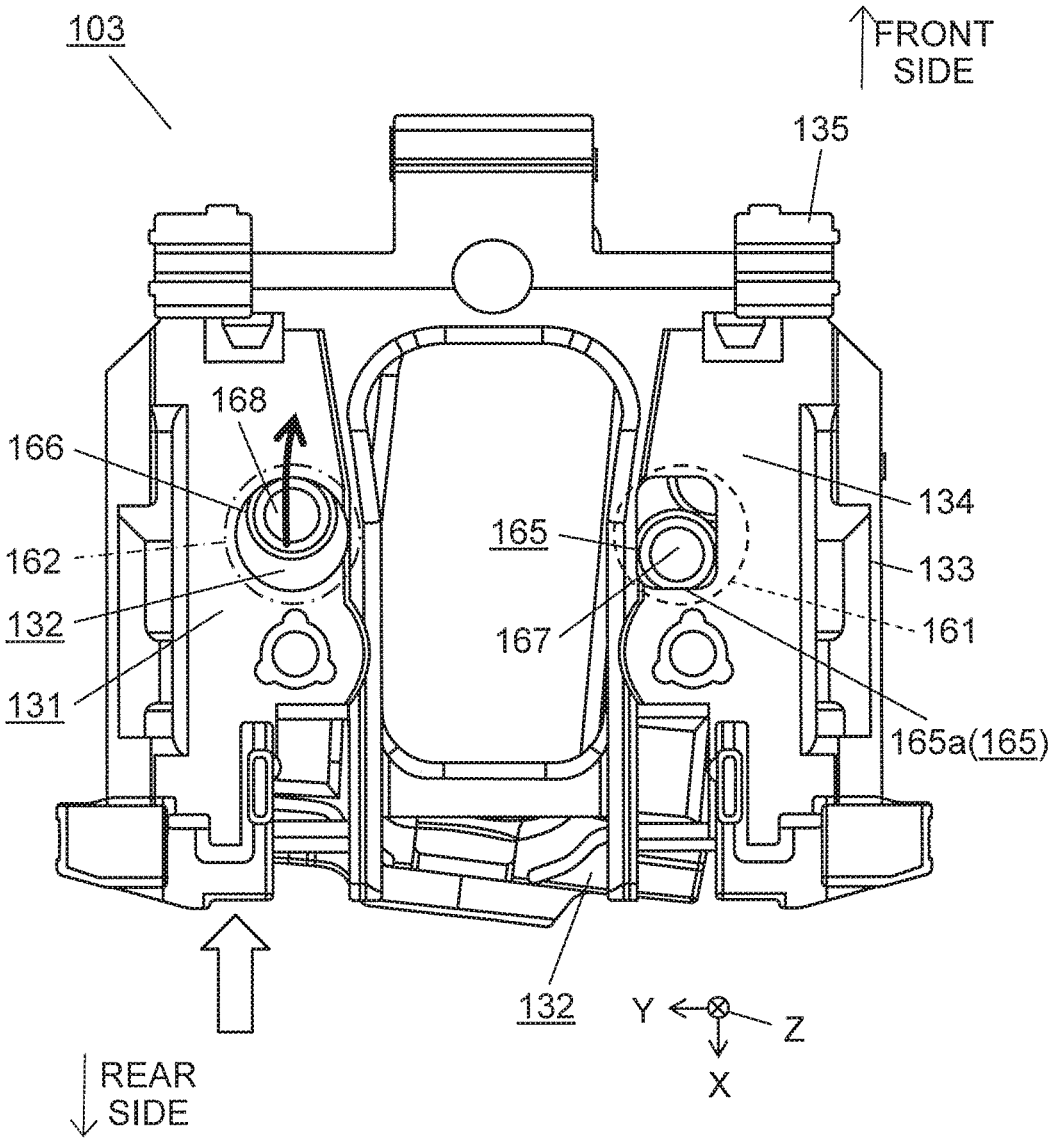
FIG. 8 is the bottom view of the joint, illustrating an example of movement of the joint.

Next, FIG. 8 illustrates movement of joint 103 relative to grip 101 in a case where force from the rear side to the front side indicated by a white arrow is applied to one end of head 102 in the horizontal direction. In this case, first protrusion 167 of first restricting portion 161 is engaged with end 165*a* on the rear side of groove 165. On the other hand, second protrusion 168 of second restricting portion 162 moves toward the front side with first protrusion 167 serving as a center, as indicated by an arrow in FIG. 8. This movement causes slide portion 132 to rotate relative to grip 101.

Figure 9:
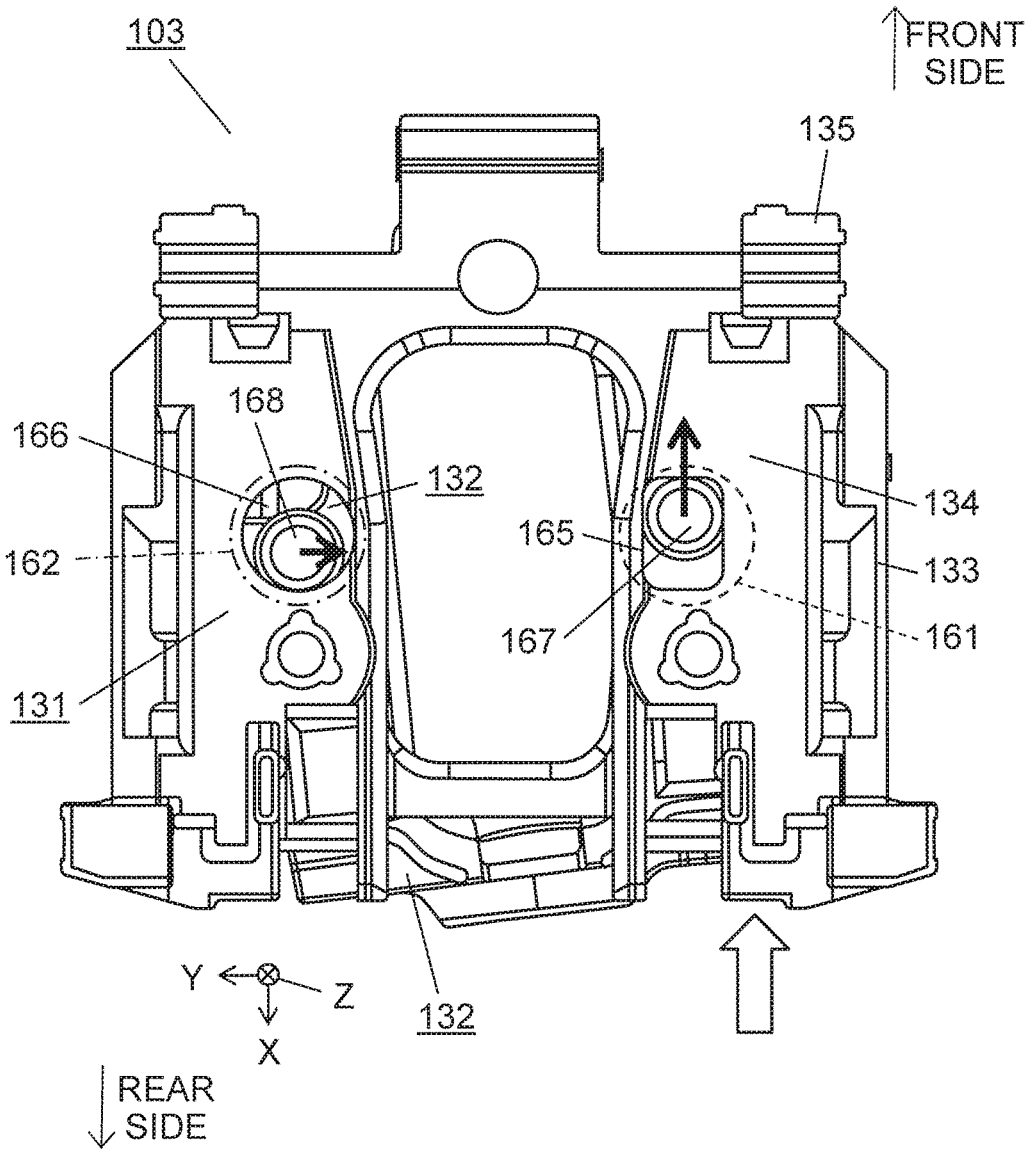
FIG. 9 is the bottom view of the joint, illustrating an example of movement of the joint.

Next, FIG. 9 illustrates movement of joint 103 relative to grip 101 in a case where force from the rear side to the front side indicated by a white arrow is applied to the other end of head 102 (an end on the other side of FIG. 8) in the horizontal direction. In this case, first protrusion 167 of first restricting portion 161 moves from the rear side to the front side along groove 165 as indicated by the arrow in FIG. 9. On the other hand, second protrusion 168 moves, as indicated by an arrow in FIG. 9, toward the other end in the horizontal direction along an inner periphery of hole 166. This movement causes slide portion 132 to rotate approximately about second protrusion 168.

Figure 10:
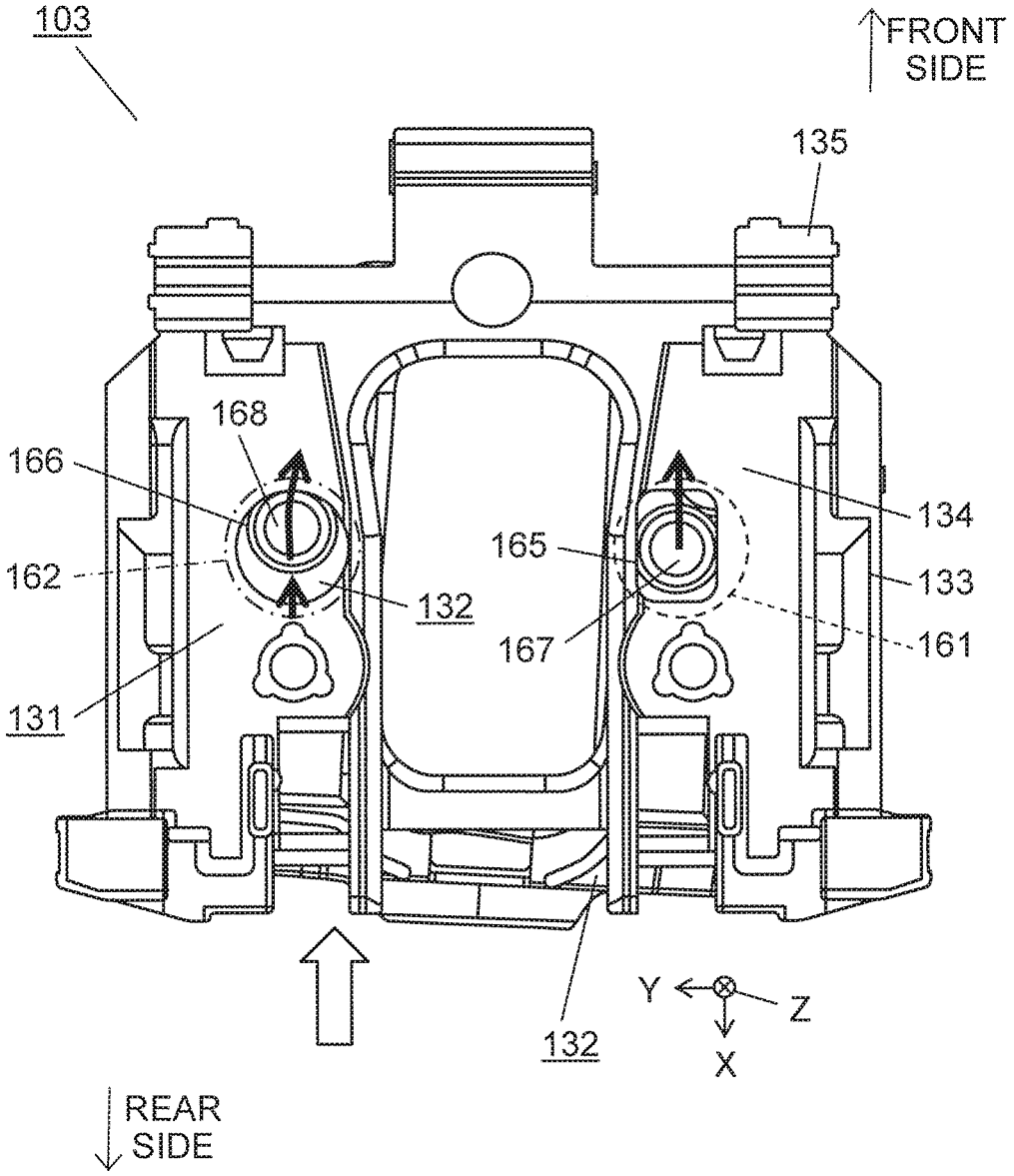
FIG. 10 is the bottom view of the joint, illustrating an example of movement of the joint.

Next, FIG. 10 illustrates movement of joint 103 relative to grip 101 in a case where force from the rear side to the front side indicated by a white arrow is applied to a midpoint between the one end and the center of head 102 in the horizontal direction. In this case, as indicated by an arrow in FIG. 10, first protrusion 167 moves toward the front side. On the other hand, second protrusion 168 moves toward the front side more than the first protrusion 167 and also moves toward the other end in the horizontal direction. This movement causes slide portion 132, relative to base 131, to simultaneously slide from the rear side toward the front side and rotate clockwise when viewed from the upper side.

Figure 11:
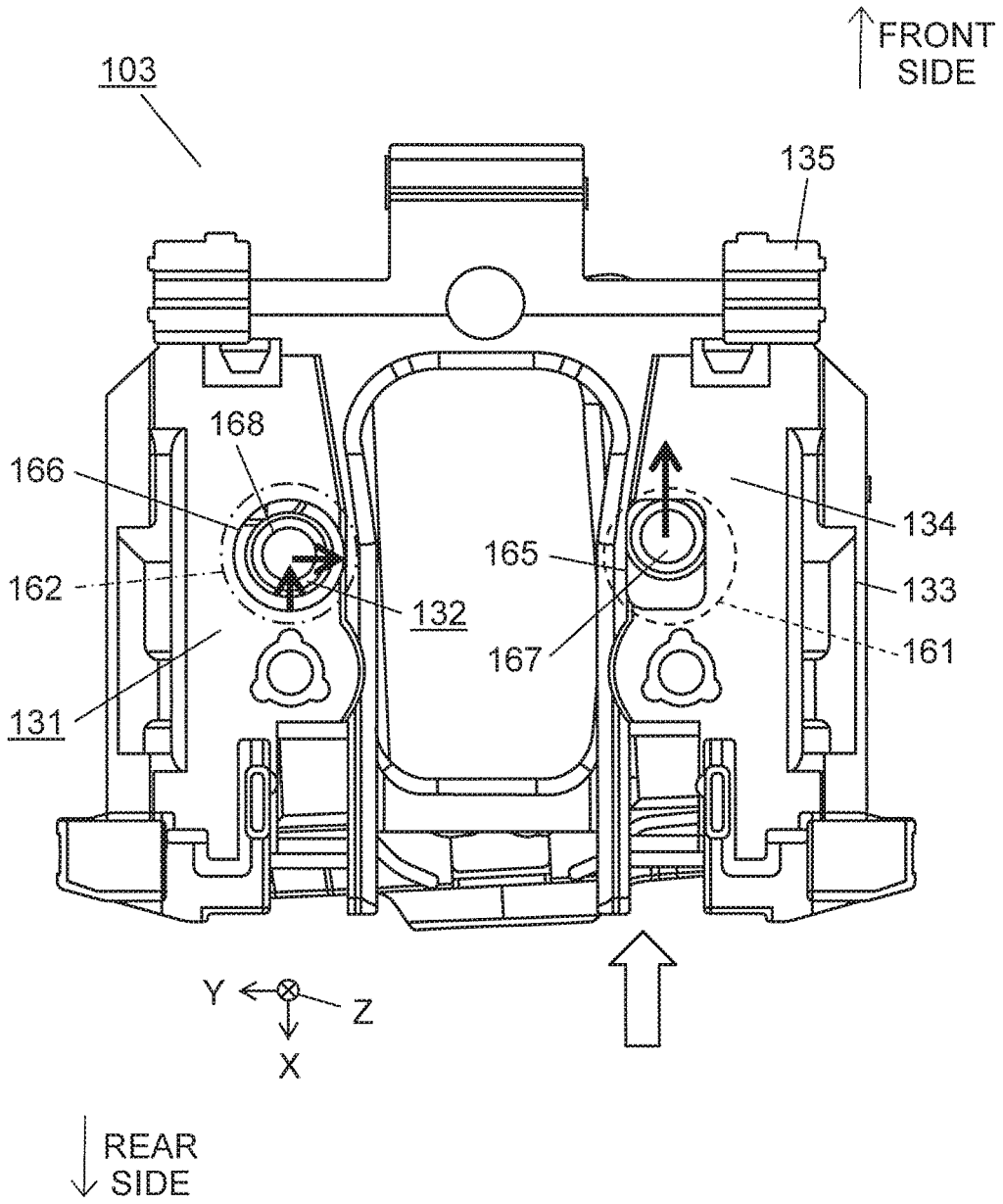
FIG. 11 is the bottom view of the joint, illustrating an example of movement of the joint.

Similarly, FIG. 11 illustrates movement of joint 103 relative to grip 101 in a case where force from the rear side to the front side indicated by a white arrow is applied to a midpoint between the other end and the center of head 102 in the horizontal direction. In this case, as indicated by an arrow in FIG. 11, first protrusion 167 moves toward the front side. On the other hand, second protrusion 168 moves toward the front side less than the first protrusion 167 and also moves toward the other end in the horizontal direction. This movement causes slide portion 132, relative to base 131, to simultaneously slide from the rear side toward the front side and rotate counterclockwise when viewed from the upper side.

As described above, joint 103 of hair cutting device 100 according to the present exemplary embodiment suitably lessens impact on skin made by head 102 when head 102 is pressed against the skin. Furthermore, joint 103 makes it possible to enhance the ability of head 102 to fellow the skin surface when hair cutting device 100 moves with the blade surface of cutting unit 121 set along the skin.

Furthermore, joint 103 causes head 102 to move in a twisting direction when head 102 moves, particularly, from an area under a jaw toward a cheek. That is, head 102 can rotate while sliding. This can bring about better contact between the blade surface of cutting unit 121 and the skin surface.

Furthermore, joint 103 causes biasing member 107 to bias slide portion 132 toward base 131. Therefore, when head 102 hits the skin, the impact is absorbed by biasing member 107, which makes it possible to more suitably lessen the impact.

As described above, joint 103 of hair cutting device 100 moves.

Hereinafter, joint 103 and constituent elements located near joint 103 will be described with reference to FIGS. 12 to 14.

Figure 12:
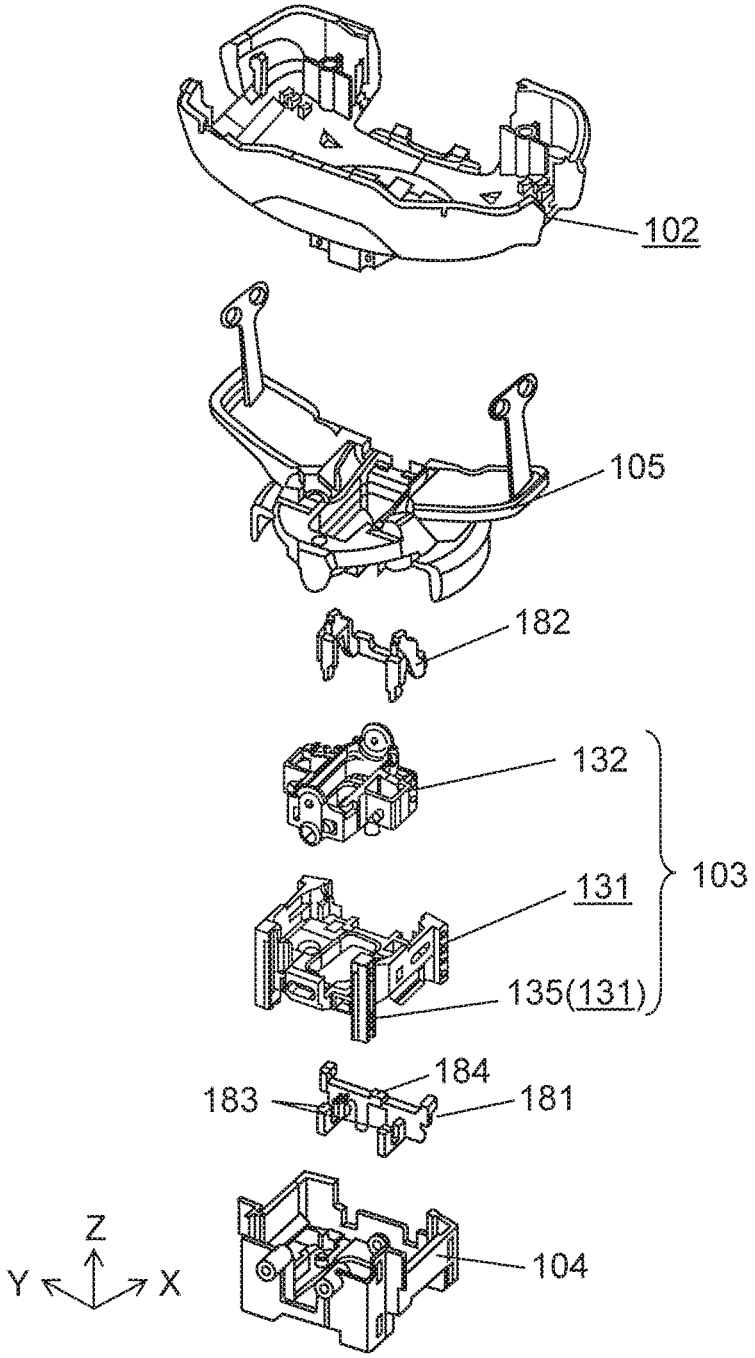
FIG. 12 is an exploded perspective view of the joint and constituent elements located near the joint.

FIG. 12 is an exploded perspective view of joint 103 and the constituent elements located near joint 103. FIG. 13 is a perspective sectional view illustrating a state where the members illustrated in FIG. 12 are assembled. FIG. 14 is a plan view illustrating a rear of hair cutting device 100.

Figure 13:
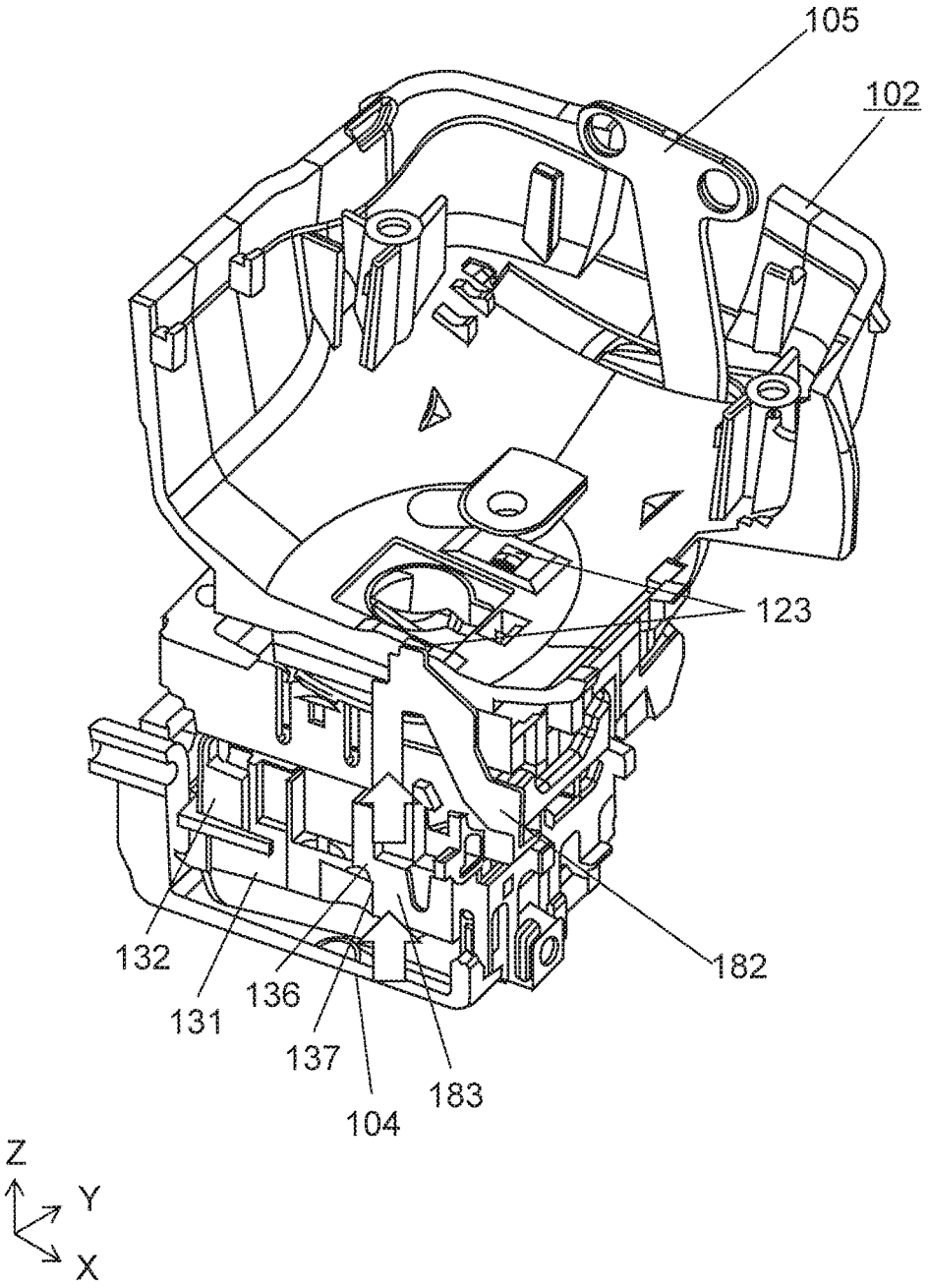
FIG. 13 is a perspective sectional view illustrating a state where the members illustrated in FIG. 12 are assembled.
Figure 14:
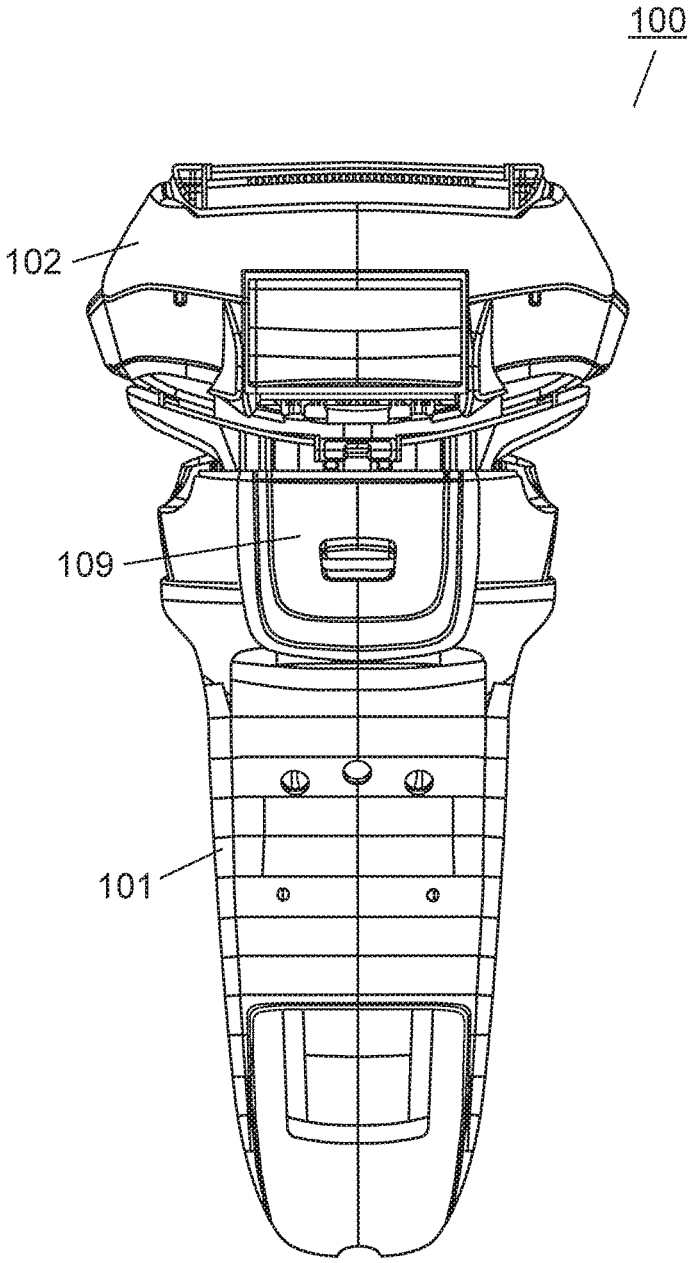
FIG. 14 is a plan view illustrating a rear of the hair cutting device.

As illustrated in FIGS. 12 to 14, hair cutting device 100 further includes first holder 104, second holder 105, first fixing member 181, second fixing member 182, operation member 109, and the like.

First holder 104 is a member that holds joint 103 so as to allow joint 103 to move within the predetermined range in the alignment of grip 101 and head 102 (vertical direction). First holder 104 according to the present exemplary embodiment is fixed to grip 101.

First holder 104 is formed of, for example, a rectangular box shaped member and accommodates base 131 of joint 103. First holder 104 holds four pillars 135 of base 131 so as to allow pillars 135 to undergo displacement in a direction orthogonal to the slide plane (corresponding to the XY plane).

Note that, between first holder 104 and base 131 of joint 103, a biasing member (not illustrated) is disposed so as to bias joint 103 in the vertical direction. The biasing member is, for example, a coil spring and biases joint 103 from grip 101 toward head 102.

Second holder 105 is a member that holds head 102 so as to allow head. 102 to pivot in the front-back direction and the horizontal direction. Second holder 105 is held by slide portion 132 of joint 103. To be more specific, second holder 105 is held by slide portion 132 so as to be pivotable, in the horizontal direction, on an axis extending in the front-back direction corresponding to the X-axis direction illustrated in the drawings. Moreover, second holder 105 holds head 102 so as to allow head 102 to pivot, in the front-back direction, on an axis extending in the horizontal direction corresponding to the Y-axis direction illustrated in the drawings.

First fixing member 181 is a member that fixes slide portion 132 so as to releasably prevent the movement of slide portion 132 relative to base 131. First fixing member 181 according to the present exemplary embodiment is a bar-shaped member including two bars 183 and beam 184 integrally connect bars 183 as illustrated in FIG. 12.

That is, first fixing member 181 simultaneously passes through both first through-hole 136 provided through slide portion 132 illustrated in FIG. 4 and second through-hole 137 provided through base 131 illustrated in FIG. 6. Note that first through-hole 136 and second through-hole 137 are each provided at two locations.

First through-hole 136 and second through-hole 137 are disposed, at an initial position, so as to be positioned on top of each other. Each of bars 183 of first fixing member 181 is disposed at a position corresponding to first through-hole 136 and second through-hole 137. First fixing member 181 is connected with operation member 109 illustrated in FIG. 14, operation member 109 being slidably disposed on a rear surface of grip 101.

Such an arrangement causes, when operation member 109 is slid in a direction from grip 101 toward head 102, first fixing member 181 to slide in synchronization with the movement of operation member 109. At this time, each of bars 183 of first fixing member 181 moves to pass through first through-hole 136 and second through-hole 137 as illustrated in FIG. 13. This movement causes slide portion 132 of joint 103 to be fixed so as not to slide, relative to base 131, on the slide plane.

Moreover, first fixing member 181 releasably prevents movement of joint 103 relative to first holder 104 with base 131 and slide portion 132 fixed to each other. To be more specific, first, operation member 109 is slid toward head 102. This movement causes first fixing member 181 and base 131 to engage with each other such that base 131 is held at the most protruding position relative to first holder 104. As a result, head 102 is fixed so as not to move in the vertical direction.

On the other hand, second fixing member 182 illustrated in FIG. 12 is a member that releasably fixes second holder 105 and head 102 relative to grip 101. Second fixing member 182 according to the present exemplary embodiment is attached to operation member 109. This configuration causes second fixing member 182 to slide in synchronization with operation member 109. At this time, as illustrated in FIG. 13, when moving toward the upper side, second fixing member 182 is inserted into recess 123 provided on a lower-side bottom surface of head 102. At the same time, second fixing member 182 presses an outer peripheral surface of head 102 toward the upper side.

That is, when operation member 109 is slid in the direction from grip 101 toward head 102, second fixing member 182 slides toward head 102 together with first fixing member 181. This movement causes second fixing member 182 to be inserted into recess 123 of head 102 and press, for example, two positions on the outer peripheral surface of head 102, as illustrated in FIG. 13. This prevents head 102 from pivoting in the front-back direction and the horizontal direction, thereby fixing second holder 105.

As described above, hair cutting device 100 according to the present exemplary embodiment allows head 102 to follow the skin surface and freely change in posture. Moreover, hair cutting device 100 can selectively fix the posture of head 102 relative to grip 101. That is, the posture of head 102 can be fixed according to a user's preference or a part to be groomed. This configuration prevents unnecessary movement of head 102. Accordingly, hair can be smoothly cut.

Furthermore, hair cutting device 100 according to the present exemplary embodiment is capable of fixing, only with two fixing members, that is, first fixing member 181 and second fixing member 182, head 102 whose posture can be changed in multiple directions. This configuration allows head 102 to be fixed with such a small room. Furthermore, only a single operation can fix all movement of head 102. Accordingly, an operation for fixing head 102 can be easier.

Note that the present disclosure is not limited to the exemplary embodiments. For example, the exemplary embodiment according to the present disclosure may include an exemplary embodiment implemented with any combination of the constituent elements described herein. Furthermore, the exemplary embodiment according to the present disclosure may include another exemplary embodiment implemented without some of the constituent elements.

Also, modifications obtained by applying to the exemplary embodiment various modifications that may be conceived of by those skilled in the art without departing from the spirit of the present disclosure, that is to say, meaning of the recitation in the claims are included in the present disclosure.

To be more specific, in the exemplary embodiment, a configuration in which cutting unit 121 provided in head 102 includes the blade block having the inner blades and the outer blades that cut hair has been described as an example, but the present disclosure is not limited to the exemplary embodiment. For example, the exemplary embodiment may further include a configuration in which a roller or the like that pinches and removes hair is employed as cutting unit 121.

What is claimed is:

1. A hair cutting device comprising:

a grip;

a head including a cutting unit that works on hair;

a first holder;

a second holder;

a power source switch; and a joint wherein the grip has a front side and a back side opposite to the front side and the power source switch is disposed on the front side, wherein the joint includes:

a base that has a bottom surface defining a slide plane, and a slide portion that is held in the base to be rotatable within a predetermined area on the slide plane, wherein the hair cutting device has a longitudinal axis along the grip and the head, and the slide plane is perpendicular to the longitudinal axis, wherein the slide portion is movable in a front back direction relative to the grip parallel to the slide plane, and is rotatable about an axis which is perpendicular to the front back direction, and wherein the first holder is fixed to the grip and holds the base of the joint, and the second holder is held by the slide portion of the joint and holds the head thereby connecting the grip to the head.

2. The hair cutting device according to claim 1, wherein:

the base and the slide portion each have a first cooperating structure that performs a restricting function, and the first cooperating structure of the base and the first cooperating structure of the slide portion work together to restrict movement of the slide portion in the front back direction and movement of the slide portion that is rotatable about the axis which is perpendicular to the front back direction.

3. The hair cutting device according to claim 2, wherein the first cooperating structure of the base is a groove, and the first cooperating structure of the slide portion is a first protrusion inserted in the groove, the groove extends in the front back direction, and the first protrusion engages with the groove during the movement of the slide portion in the front back direction and the movement of the slide portion that is rotatable about the axis which is perpendicular to the front back direction.

4. The hair cutting device according to claim 3, wherein the slide portion and the base each have a second cooperating structure, the second cooperating structure of the slide portion is a second protrusion, the second cooperating structure of the base is a hole, wherein the second protrusion is disposed in the hole, the second protrusion is formed on the slide portion, the second protrusion protruding in a direction identical to a direction in which the first protrusion protrudes, and the hole is formed in the base, the hole allowing the second protrusion to move within and allowing the second protrusion to move within a predetermined range as the slide portion moves in the front back direction and rotates about the axis.

5. The hair cutting device according to claim 1, further includes at least one biasing member, wherein the at least one biasing member is an elastic member with two ends, one end is accommodated in the base, the other end is in contact with the slide portion, and the at least one biasing member biases, in a predetermined direction, the slide portion toward the base on the slide plane.

6. The hair cutting device according to claim 5, wherein the at least one biasing member biases the slide portion along the front back direction.

7. The hair cutting device according to claim 6, wherein the at least one biasing member includes a first biasing member and a second biasing member that are arranged side by side in parallel to the slide plane and bias the slide portion along the front back direction.

8. The hair cutting device according to claim 1, further comprising a first fixing member that releasably fixes the slide portion to the base.

9. The hair cutting device according to claim 8, wherein the first holder holds the base of the joint such that the joint is movable within a predetermined range along the longitudinal axis, and wherein the first fixing member releasably prevents movement of the joint relative to the first holder.

10. The hair cutting device according to claim 8, further comprising:

a second fixing member that releasably fixes the second holder and the head relative to the grip; and an operation member disposed on the back side of the grip, wherein the operation member simultaneously moves the first fixing member and the second fixing member to simultaneously operate respective fixing actions or respective release actions, wherein the slide portion further includes a bearing portion, the second holder is held by the bearing portion to be rotatable about an axis extending in the front-back direction, and the second holder holds the head such that the head is pivotable.

11. The hair cutting device according to claim 9, further comprising:

a second fixing member that releasably fixes the second holder and the head relative to the grip; and an operation member disposed on the back side of the grip, wherein the operation member simultaneously moves the first fixing member and the second fixing member to simultaneously operate respective fixing actions or respective release actions, wherein the slide portion further includes a bearing portion, the second holder is held by the bearing portion to be rotatable about an axis extending in the front-back direction, and the second holder holds the head such that the head is pivotable.

* * * * *